United States Patent [19]

Jones

[11] Patent Number: 5,026,048

[45] Date of Patent: Jun. 25, 1991

[54] MARTIAL ARTS 360 DEGREE STRIKING TARGET

[76] Inventor: Thomas G. Jones, 20422 Beach Blvd., #325, Huntington Beach, Calif. 92648

[21] Appl. No.: 569,650

[22] Filed: Aug. 20, 1990

[51] Int. Cl.[5] ..... A63B 69/00

[52] U.S. Cl. ..... 272/77; 272/76; 272/78; 273/55 R; 273/55 A

[58] Field of Search ..... 272/76, 77, 78; 273/55 A, 55 R

[56] References Cited

U.S. PATENT DOCUMENTS 714,456 11/1902 Cripper ..... 272/78
3,216,724 11/1965 Williams ..... 273/55 R
3,416,795 12/1968 Lewis et al. ..... 273/55 A
3,427,021 2/1969 Donato ..... 273/55 R
3,700,237 10/1972 Kopp ..... 273/55 A
4,635,929 1/1987 Shustack ..... 272/77
4,946,159 8/1990 Jones ..... 272/76

*Primary Examiner*—Richard J. Apley
*Assistant Examiner*—Karen G. Horowitz
*Attorney, Agent, or Firm*—Beech & Collins

[57] ABSTRACT

An improved Martial Arts Striking Surface having an outer striking surface that impacts a circumferential plate connected by compression springs to an interior support pole. The device provides suffficient resistance to simulate a real target while giving way to allow the impact to be absorbed over distance.

4 Claims, 1 Drawing Sheet

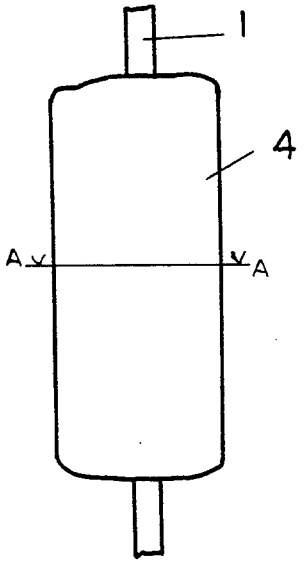

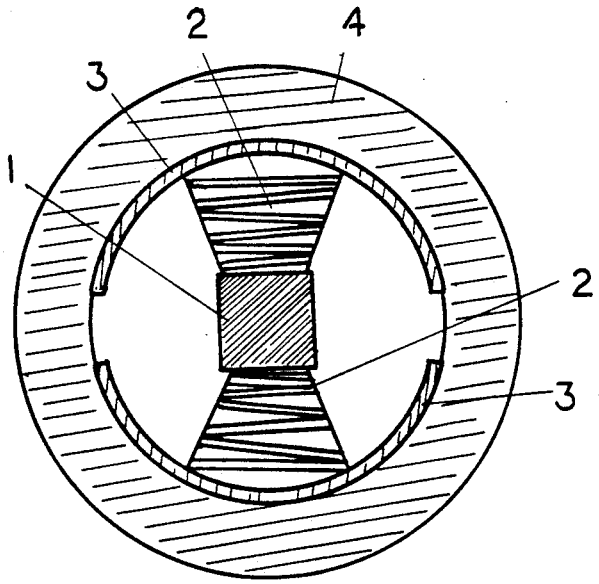

MARTIAL ARTS 360 DEGREE STRIKING TARGET

1. The martial arts 360 degree striking target relates to devices that are used to provide an object that can be struck that simulates striking a person without hurting the person using the device.

2. DESCRIPTION OF PRIOR ART.

Many devices such as punching bags, cushions, and paddles are used to provide a striking surface. These surfaces when held by a machine do not provide an object that provides sufficient resistance while giving way to allow the impact to be absorbed over a distance. The improved martial arts striking target overcomes this by providing a 360 degree surface that gives an impact yet instantly returns to the initial position after repeated strikes.

OBJECTIVES OF THE INVENTION

The primary objective of the Martial Arts 360 Degree Striking Target is to provide a striking surface that can be struck in 360 degrees yet provides a sufficient resistance while giving an impact to simulate an actual strike. In accordance with the description herein other objectives of this invention will become apparent when the description and drawings are reviewed.

BRIEF DESCRIPTION OF THE DRAWINGS

FIG. 1 illustrates the front view of the invention.

FIG. 2 illustrates the top view of the invention.

FIG. 3 illustrates a cross-section of the striking surface.

DESCRIPTION OF THE PREFERRED EMBODIMENT

Referring to FIGS 1 through 3 the martial arts 360 degree striking surface is composed of a support pole (1) that provides the support for the entire unit and extends axially a sufficient distance to be securely held at either end. The support pole (1) is sufficiently strong to not bend or deform with the strongest blow. A solid steel bar or tubing are sufficient but any strong material would be adequate. At right angles to the support pole (1) are conical springs (2). Conical springs (2) are preferred as they allow the spring to collapse into itself. A plurality of conical springs (2) are provided both around the support pole (1) as well as along the axis of support pole (1). The actual number is varied depending on the desired length of the striking surface. Although only one is sufficient, a plurality of circumferential plates (3) are attached to the outer parts of the conical springs (2) to distribute the force. A plurality is preferred because of the ease of manufacture. A striking force on the circumferential plate (3) is transferred to the conical springs (2) and the plate is allowed to compress the conical springs (2). An outside cushion of padding (4) is attached around the entire outside surface circumferentially to the plates (3). An additional outside covering such as canvas may be attached to provide an easily cleaned surface but is not essential to the invention.

I claim:

1. An improved martial arts striking surface comprised of:

a) an interior substantially rigid support pole;

b) a plurality of springs radially extending around the support pole, having one end attached at right angles to the interior support pole;

c) at least one plate attached to the other end of the springs opposite the interior support pole; and d) an outside cushioned covering to encircle said plate and said springs;

wherein said support pole extends beyond the ends of said covering a sufficient distance to be securely held at either end.

2. As in claim 1 wherein the plate is comprised of a plurality of smaller plates.

3. As in claim 1 wherein the springs are conical springs.

4. As in claim 1 wherein the outside cushioned covering is comprised of two coverings, an inner covering of padding and an outside covering of canvas material.

* * * * *